United States Patent [19]

Lohmann

[11] Patent Number: 4,933,683

[45] Date of Patent: Jun. 12, 1990

[54] JETTISON RAIN COVER FOR INTELLIGENT WEAPONS

[75] Inventor: Arthur M. Lohmann, Hopkins, Minn.

[73] Assignee: Honeywell, Inc., Minneapolis, Minn.

[21] Appl. No.: 284,508

[22] Filed: Dec. 15, 1988

[51] Int. Cl.[5] ..... H01Q 1/42

[52] U.S. Cl. ..... 343/872; 343/873

[58] Field of Search ..... 343/872, 873

[56] References Cited

U.S. PATENT DOCUMENTS 4,797,683 1/1989 Kosowsky et al. ..... 343/872

*Primary Examiner*—Rolf Hille
*Assistant Examiner*—Doris J. Johnson
*Attorney, Agent, or Firm*—Donald A. Jacobson

[57] ABSTRACT

A jettisoning cover for a munition arranged to be held against the end of a ring secured to the end of a munition which is fired at a high velocity through the atmosphere. The cover protects the contents of the munition from the high velocity through the atmosphere but is jettisoned after the velocity has slowed. The cover is held by two clips on the ring directed over the cover and a third clip on the cover engaging a notch in the ring. A detent mounted within a recess in the ring extending into a hole in the cover secures the cover in place.

The detent is secured by a shear pin through the detent and an adjacent slider in an arcuate channel. The slider is propelled by an explosive powered piston which shears the shear pin to release the cover. A spring from the cover is wrapped around the ring when the cover is attached and provides energy to jettison the cover when the cover is released.

8 Claims, 7 Drawing Sheets

JETTISON RAIN COVER FOR INTELLIGENT WEAPONS

The Government has rights in this invention pursuant to Contract No. DAAA21-86-C-0308, awarded by Department of the Army.

BACKGROUND OF THE INVENTION

Many high technology weapons are delivered at high velocity by aircraft, rockets or artillery. A number of these are intelligent precision weapons which utilize fragile antennas or payload which must be protected against rain until the passage of the weapon has reduced the velocity of the weapon through the air to a level the antenna can tolerate. Typically these antennas cannot function if there is any metal or other material that attenuates electromagnetic radiation between the antenna and the target to be sensed. This requires a protective cover which can withstand the high velocity environment with rapid rotation along with vibration and buffeting, which will remain in place as a protective shield for the antenna but which can be jettisoned reliably immediately prior to the antenna use.

The requirements of such a cover are the capabilities to survive high launch acceleration, high spin rates, impact air loading up to 85 pounds per square inch, explosive gases, side loading from weapon wobble and ejection from a carrier, multi-Mach level velocity, and rain drop impacts. The cover system must provide a jettison feature which functions at reduced air speeds of around 350 feet per second. Since the cover is in a sense parasitic as regards to the primary function of the munition, the protective cover along with its jettison and release mechanisms must be small, light weight and inexpensive. There are no existing devices which can serve as antenna or payload protective covers and which are jettisoned prior to actuating the system.

SUMMARY OF THE PRESENT INVENTION

The protective cover is a circular disk with a washer shaped edge reinforcement secured over an antenna by attachment to a flat ring mounted on the end of a cylinder enclosing the munition and antenna. The antenna is arrayed on a circular disk shaped surface which is installed immediately under the protective cover.

The release mechanism is incorporated partially into the flat ring and partially into the cover. Three clips deployed symmetrically about the cover hold the cover against the ring. Two cover clips are attached to the ring and directed inwardly to engage mating grooves in the cover. A third ring clip is attached to the cover and directed inwardly to engage a mating notch in the ring. With no further restraints than these three clips, the cover will readily disengage from the ring because the cover can translate away from the cover clips to disengage them which will also disengage the ring clip and free the cover. To prevent this separation a detent is mounted within a recess in the ring near the ring clip and extends upward into a hole through the cover to prevent the cover from moving away from the two cover clips. The detent is held in place by a shear pin through a hole in the detent and an adjacent part. This arrangement by itself would provide the necessary attachment between the cover and ring but has no provision to jettison the cover.

The jettisoning mechanism utilizes a spring, slider and explosive piston actuator. An arcuate channel in the ring contains the slider and piston actuator. The slider is curved to mate with and slide along the channel and is driven along the channel by the actuator when fired. The detent is mounted in a recess which adjacent the inside edge of the arcuate channel with the detent recess communicating with the arcuate channel. The detent and slider are held together by a shear pin extending through both. The parts as assembled are interlocked in that the cover holds the slider within the arcuate channel, while the shear pin from the slider holds the detent in place extending upward into the cover hole, which holds the cover in place. When the piston actuator is fired the slider severs the shear pin and moves a cutout in the slider opposite the detent which first releases the detent and second provides a space for the detent to tip out of the cover hole to free the cover. The spring is flat, short, stiff and straight and is as wide as the ring. The spring is attached to the cover and extends outward tangential to the ring. When the cover is attached to the ring the end of the spring is placed under a projection in the circumference of the ring and the spring wrapped around the ring as the cover is aligned with the ring and secured by the detent. As the cover is aligned and the spring is bent around the ring, energy is stored in the spring. The inside edge of the hole in the cover through which the detent extends bears against the detent because of the spring force which holds the cover in place. When the piston actuator drives the slider it then shears the shear pin to release the detent thus allowing the spring acting against the cover to incline the detent below the cover hole and free the cover. A cutout in the outside edge of the arcuate channel opposite the detent recess both provides access to insert the shear pin in place through the slider and the detent and also provides a space for the detent to tip outward. The spring can then translate and rotate the cover away from the ring and the antenna. The spring is short and stiff because otherwise the acceleration forces and vibration acting on the spring could bend or dislodge it. When the cover moves such that approximately half of its surface is exposed to the relative wind due to the motion of the cover through the air, the cover is stripped from the ring by the air to provide immediate deployment.

DETAILED DESCRIPTION OF THE PREFERRED EMBODIMENT

Figure 1:
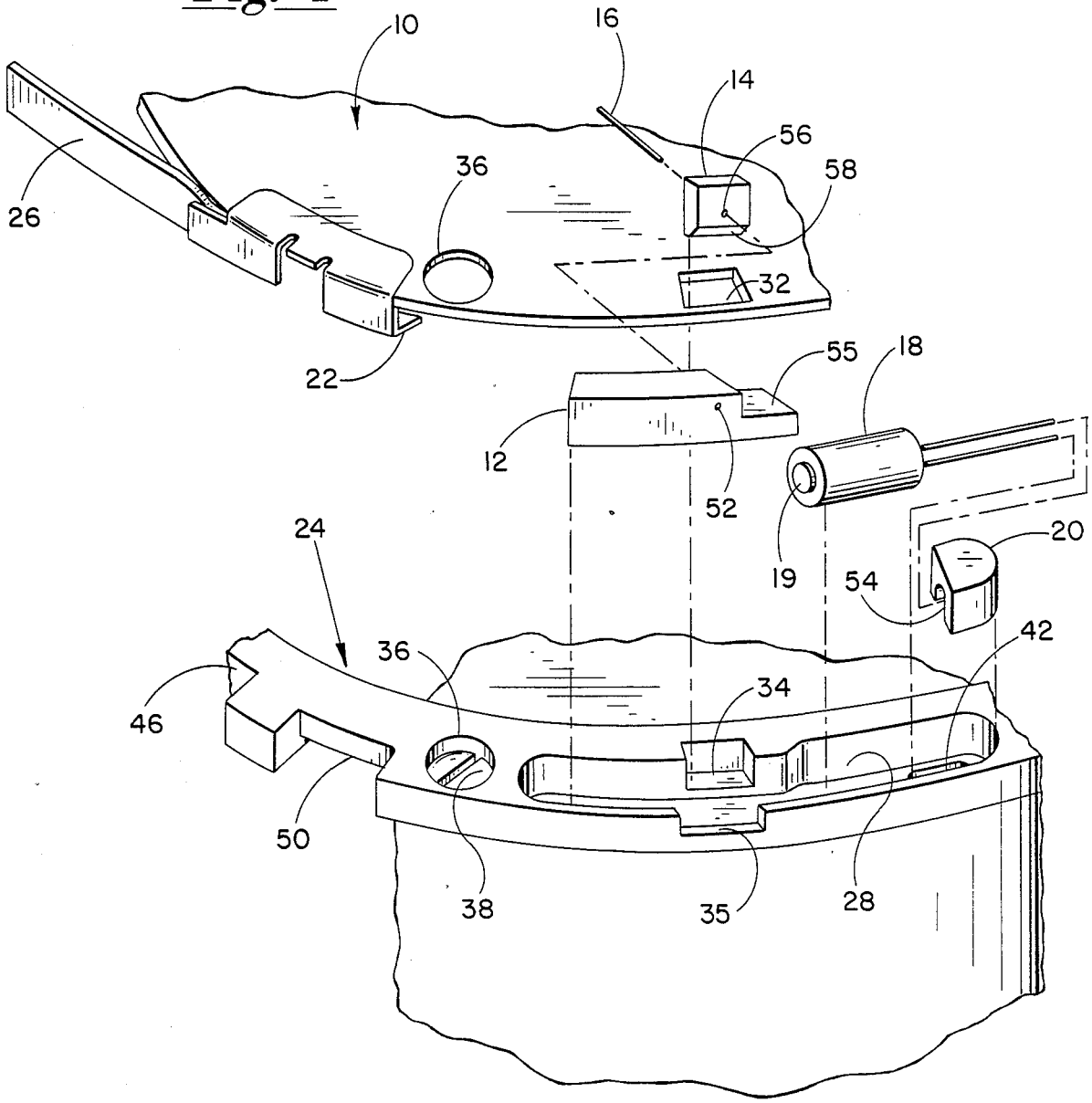
FIG. 1 shows the portion of the cover and ring containing the operating elements of the apparatus.

In FIG. 1 a portion of a cover 10, a slider 12, a detent 14, a shear pin 16, an explosive piston actuator 18, a back stop 20, a ring clip 22, a portion of ring 24, spring 26, an arcuate channel 28, a hole 32 in cover 10, a recess 34 for the detent, cutout 35 in the ring and a slotted hole 42 through the ring from the arcuate channel are shown. These constitute the primary working parts of the invention.

Figure 6:
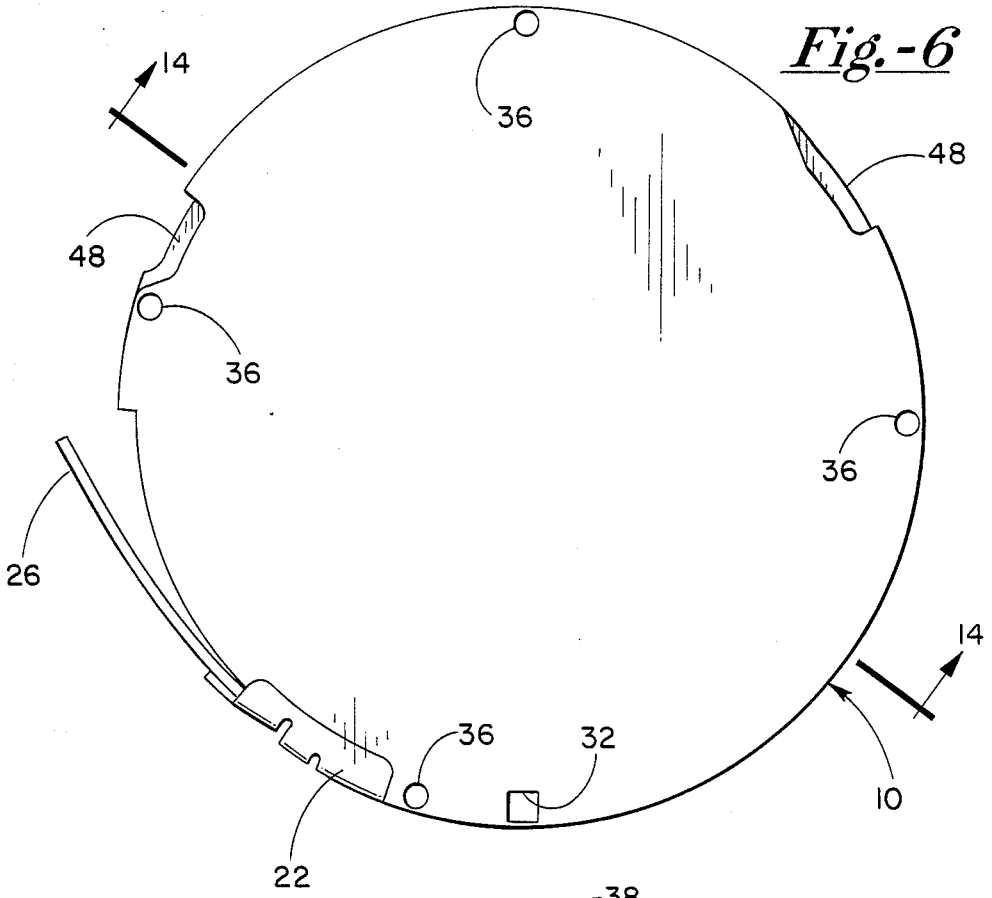
FIG. 6 shows the top view of the cover.
Figure 7:
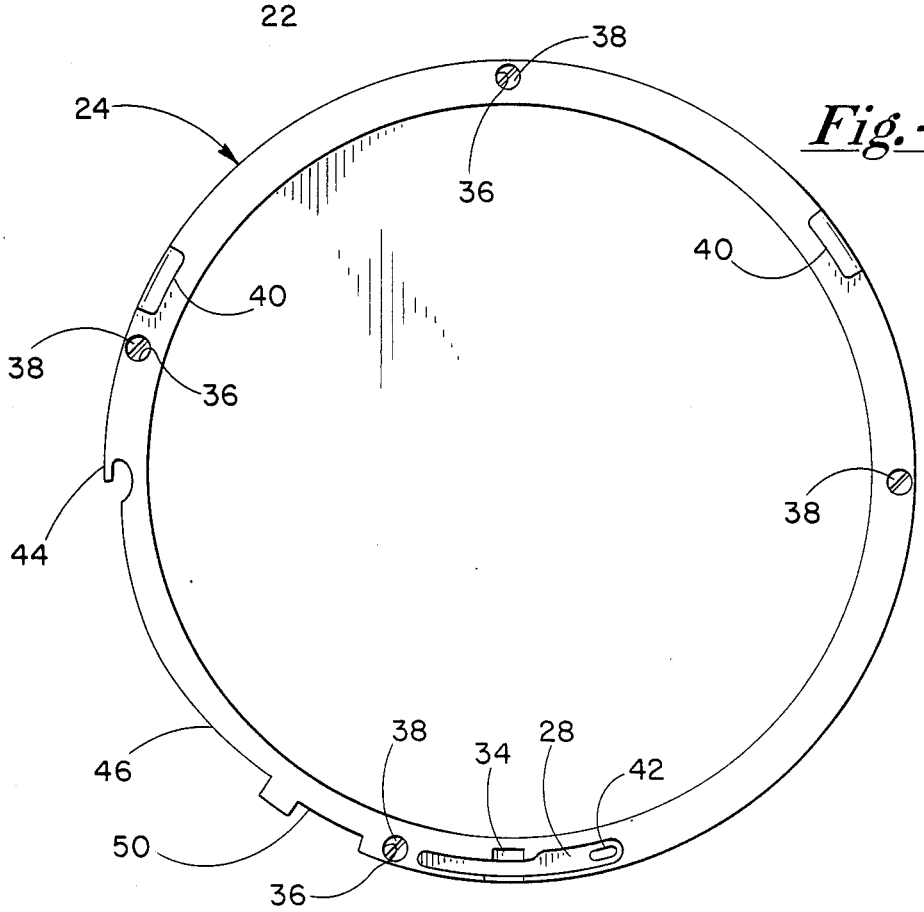
FIG. 7 shows the top view of the ring.

In FIGS. 6 and 7 cover 10 and ring 24 are shown with their attached parts. Four access holes 36 in ring 10 provide access to bolts 38 which are used to secure ring 24 to a munition. Two cover clips 40 are directed upward then inward from the periphery of ring 24. Recess 34 is shown adjacent channel 28. Slotted hole 42 extending from the bottom of channel 28 provides a path for the wires used to fire piston actuator 18. A projection 44, recess 46 and notch 50 in the periphery of ring 24 provide space for spring 26 and ring clip 22 respectively. Ring clip 22 is used to secure spring 26 tangentially to cover 10 in addition to providing an attachment means for the cover to ring 24. Hole 32 extends through cover 10. Grooves 48 in cover 10 provide a mating surface to receive clips 40. Ring clip 22 engages ring 24 in notch 50.

Figure 10:
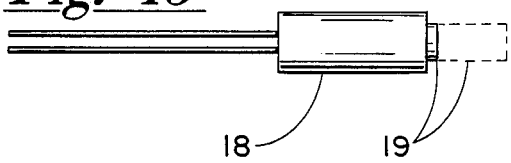
FIG. 10 shows the piston actuator with the piston in solid outline before firing and after firing in dashed outline.

Details of critical individual parts are shown in FIGS. 10 through 13 are shown in the various views. In FIG. 10 explosive piston actuator 18 is shown in solid outline prior to firing and with piston 19 extended in dashed outline after firing. The wires extending leftward from piston actuator 18 convey electrical energy to explode an explosive charge within the piston actuator to extend piston 19 when a suitable voltage is impressed across the two wires. Piston actuator 18 is used to initiate the jettison sequence as will be explained later.

Figure 11A:
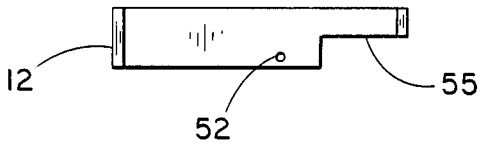
FIG. 11A shows the left side view of the slider.
Figure 11B:
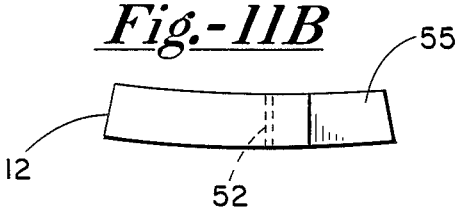
FIG. 11B shows the top view of the slider.
Figure 11D:
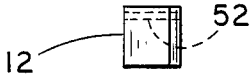
FIG. 11D shows the left end view of the slider.
Figure 11C:
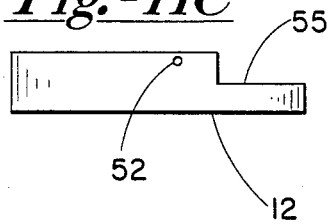
FIG. 11C shows the right side view of the slider.
Figure 11E:
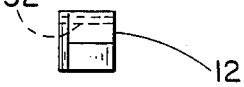
FIG. 11E shows the right end view of the slider.
Figure 12A:
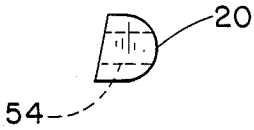
FIG. 12A shows the top view of the back stop.
Figure 12B:
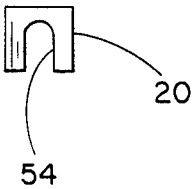
FIG. 12B shows the left end view of the back stop.
Figure 12C:
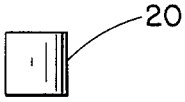
FIG. 12C shows the right side view of the back stop.
Figure 12D:
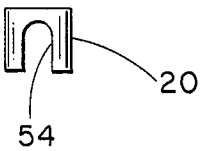
FIG. 12D shows the right end view of the back stop.
Figure 12E:
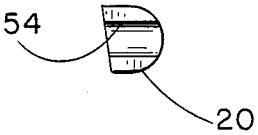
FIG. 12E shows the bottom view of the back stop.

In FIGS. 11A through 11E slider 12 is shown. Cutout 55 and hole 52 for the shear pin 16 are shown. In FIG. 11B the curved shape of slider 12 which matches the curve of arcuate channel 28 can be seen.

In FIGS. 12A through 12D the arc shaped opening 54 in back stop 20 can be seen, which provides a path for the wires from piston actuator 18 to slotted hole 42 shown in FIG. 1.

Figure 13B:
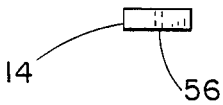
FIG. 13B shows the top view of the detent.
Figure 13A:
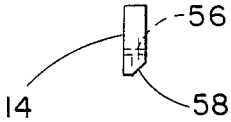
FIG. 13A shows the left side view of the detent.
Figure 13C:
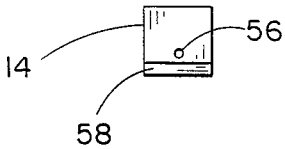
FIG. 13C shows the front view of the detent.

In FIGS. 13A through 13C, hole 56 through detent 14 for shear pin 16 and the wedge shaped end 58 of the detent are shown. The purpose of the wedge shape will be discussed later.

Figure 8:
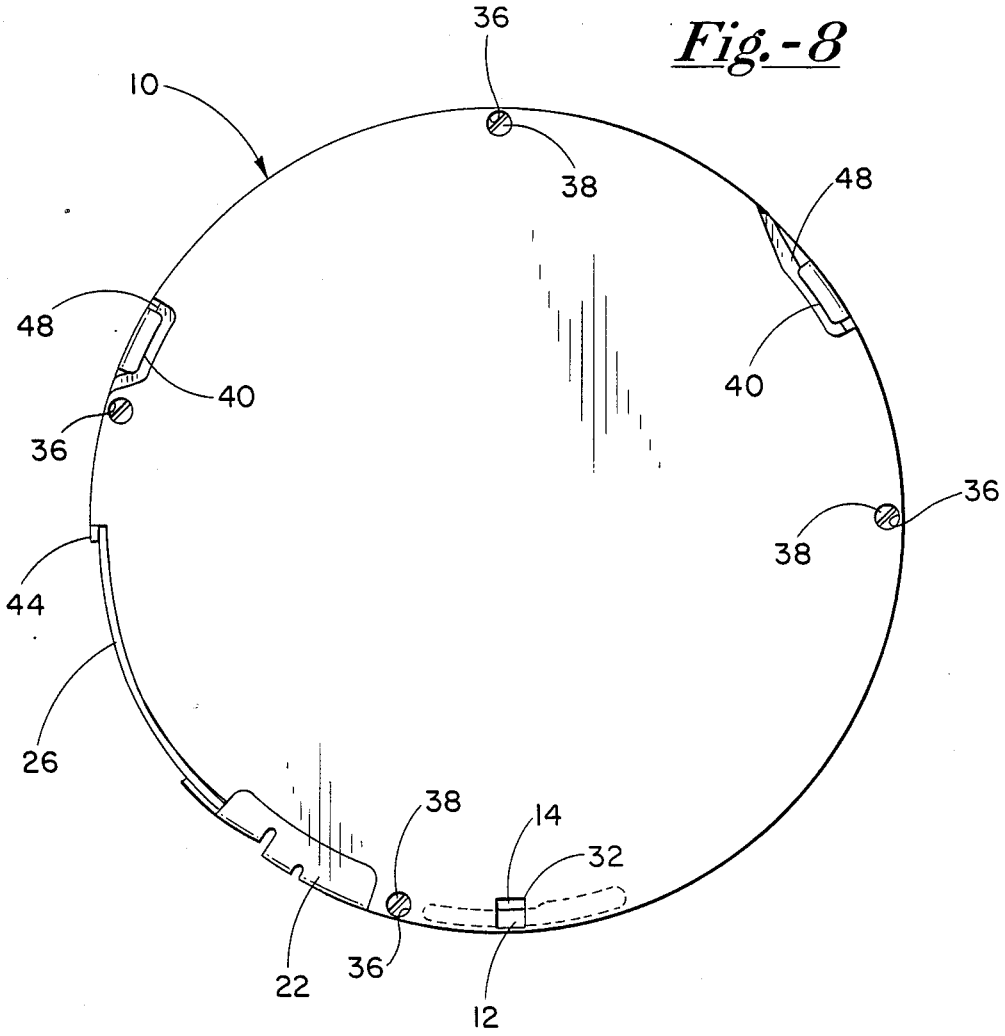
FIG. 8 shows the cover mounted over the ring with the arcuate channel containing the jettisoning mechanism shown in dashed outline.

In FIG. 1 the relationship of cover 10 and ring 24 are the same as also shown in FIG. 8, excepting only the disposition of spring 26, with a hole 36 aligned with a bolt 38 and with detent hole 32 in the cover immediately above detent recess 34 opposite slider 12. Shear pin 16 extends through hole 56 in detent 14 and through hole 52 in slider 12 and holds the detent within the recess 34 and also locks the slider in place. One function of cutout 35 is to permit inserting shear pin 16 first through hole 52 in slider 12 and then through 56 in detent 14 after they are positioned as shown. Detent 14 also extends upward into hole 32 in the plane of cover 10 which holds the cover in place with ring clip 22 engaging notch 50 in the edge of ring 24. The wedge shaped end 58 of detent 14 faces downward and outward. Back stop 20 is adjacent a mating curved end of arcuate channel 28. Wires extending from the end of piston actuator 18 opposite piston 19 are led through opening 54 in back stop 20 and thence through slotted hole 42 to a control system which provides a suitable voltage across the wires to fire the piston actuator at the proper time to jettison ring 10. With the parts positioned as shown in FIG. 1, but with spring 26 also located within notch 44 as shown in 8, the cover is secured in place for firing.

Figure 2:
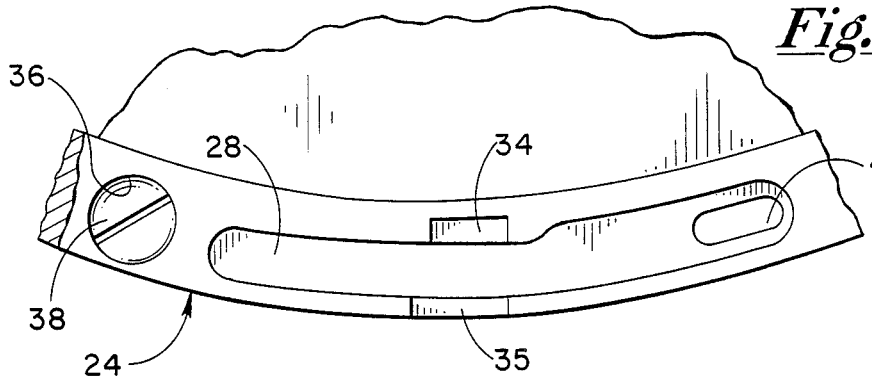
FIG. 2 shows the top view of the portion of the ring shown in FIG. 1 only with the cover omitted.
Figure 3:
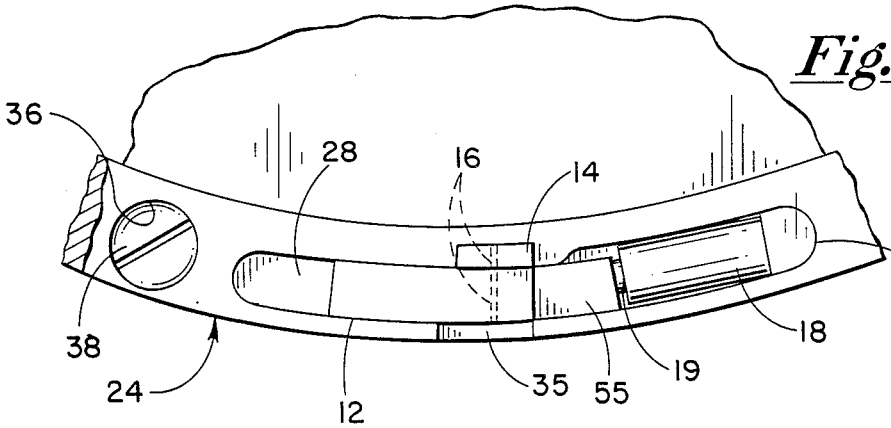
FIG. 3 shows the same portion of the ring as FIG. 2 with the operating elements included as arranged prior to operating the jettisoning mechanism.

FIGS. 2 through 5 show the successive steps of operation of the apparatus when cover 10 is jettisoned with the cover omitted here to show the operation itself more clearly. In FIG. 2 the cooperating parts are omitted to show only ring 24. In FIG. 3 the cooperating parts are shown in place prior to firing piston actuator 18 having detent 14 secured to slider 12 by shear pin 16 which is opposite cutout 35.

Figure 4:
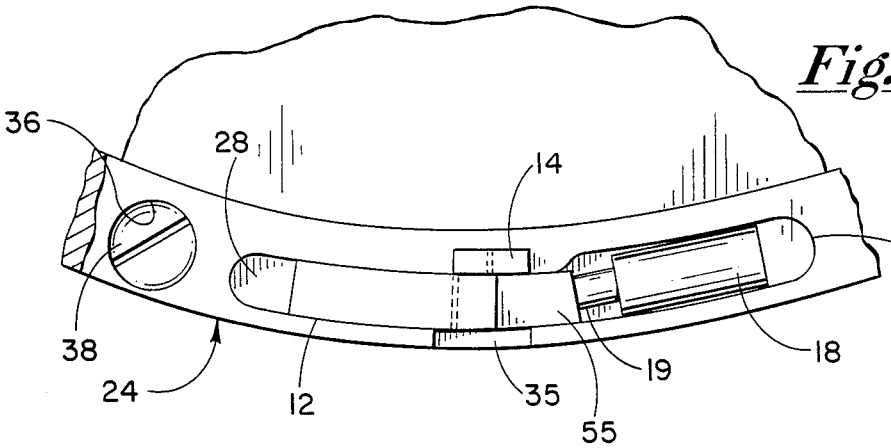
FIG. 4 shows the same view as in FIG. 3 after the jettisoning mechanism has been activated and the jettisoning cycle partially completed.

In FIG. 4 piston actuator 18 has been fired and piston 18 is partially extended which drives slider 12 leftward and shears shear pin 16 with one portion of the pin remaining within detent 14 and a second portion remaining within the slider.

Figure 5:
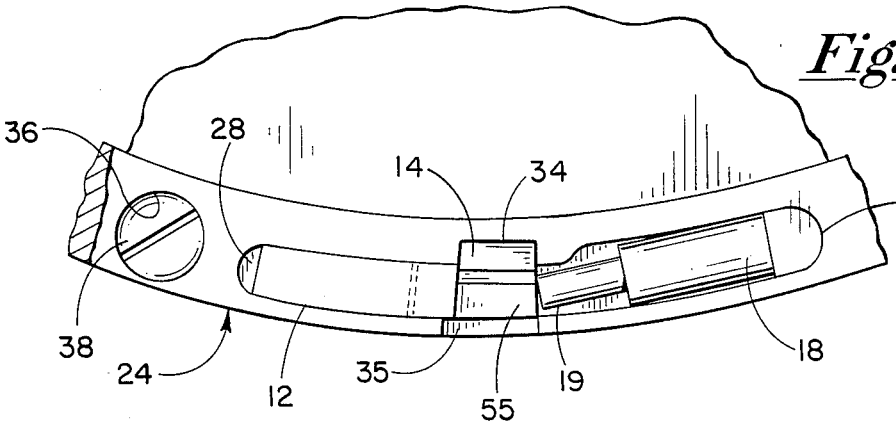
FIG. 5 shows the same view as FIG. 3 after the jettisoning cycle has been completed.

In FIG. 5 piston 19 is fully extended which drives slider 12 fully leftward with slider cutout 55 directly opposite recess 34 and cover hole 32 to permit detent 14 to move radially outward from the recess. The wedge shaped end 58 of detent 14 allows the upper end of the detent to tip outward from recess 34 through cover hole 32 and thence through cutout 35. Cutout 35 is essential to insure the release of detent 14 in that it provides detent 14 space to tip outward and clear hole 32 in cover 10. Detent hole 32, shown in FIG. 8, is directly above slider cutout 55 and recess 34 to permit the force of spring 26 acting upon cover 10 to tip the freed detent 14 as shown in FIG. 5 since when detent 14 is freed cover 10 is no longer held by the detent and can translate away from cover clips 40 to tip the detent and release the cover.

Figure 9:
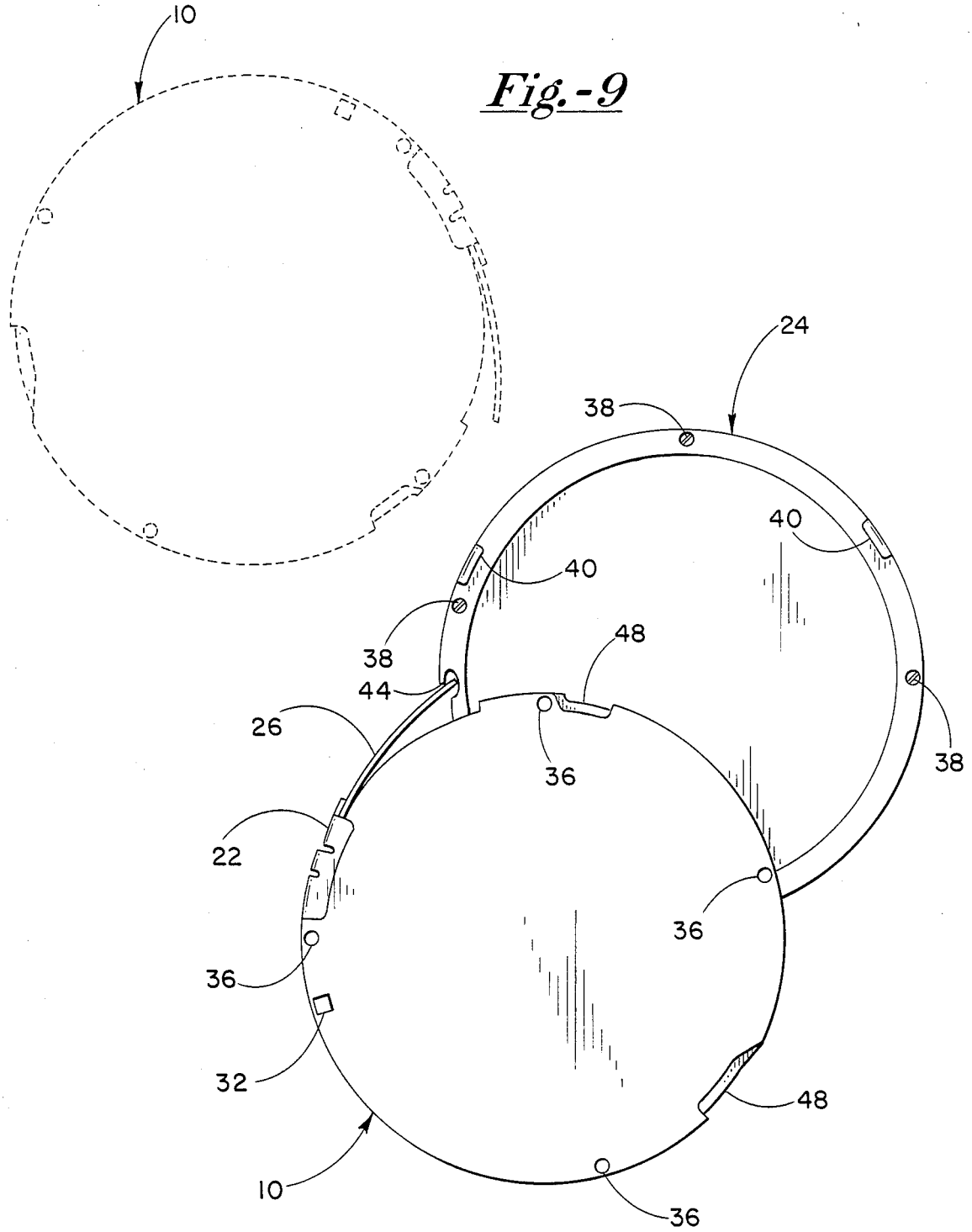
FIG. 9 shows the ring with the cover partially jettisoned in solid outline and completely jettisoned in dashed outline.

In FIG. 9 the results of releasing cover 10 from ring 24 are shown with cover 10 released. Spring 44 can straighten which accelerates the cover 10 leftward and downward and also imparts a clockwise rotation. The large force generated by spring 26 insures that this process will occur promptly after the detent 14 is freed. As soon as cover 10 extends approximately half way beyond ring 24 the air stream passing around the munition will strip cover 10 free from the munition, as shown in dashed outline, to complete the jettisoning operation.

To attach cover 10 to ring 24 to provide this jettisoning capability for the cover, piston actuator 18, back stop 20 and slider 12 are placed in arcuate channel 28 as shown in FIG. 3 with the wires from the piston actuator extending through hole 54 in back stop 20 and thence through slotted hole 42 in ring 24, not shown in this figure. Spring 26 is then placed under projection 44 in ring 24 with cover 10 oriented generally as shown in solid outline in FIG. 9. Cover 10 is then rotated and positioned until aligned with the ring 24 as shown in FIG. 8. Cover 10 is then secured by detent 14 locked to slider 12 by shear pin 16 inserted through cutout 35 into the detent and is staked in slider 12 to lock the shear pin in place in the harsh environment. Spring 26 is bent around the circumference of ring 24 within depression 46 when cover 10 is attached in this manner. Cover 10 is prevented from translating by detent 14 extending into hole 32 to hold the cover within grooves 48 and ring clip 22 engaging ring 24 within notch 50, not shown in this figure. Access holes 36 are also aligned with bolts 36 to permit the entire assembly to be connected or disconnected from the munition proper. With spring 26 bent around the circumference of ring 24 an initial restoring force on the order of fifty pounds is generated against cover 10.

The essence of the jettisoning operation utilizes the securing of detent 14 within recess 34 by shear pin 16 holding the detent and slider 12 together. When piston actuator 18 is fired forcing slider 12 along arcuate channel then shear pin 16 is severed to free detent 14 after which slider cutout 55 is positioned opposite detent 14 and ring cutout 35. The force of spring 26 acting in cover 10 insures that detent 14 will tip outward into slider cutout 55 and ring cutout 35 to free cover 10 and allow spring 26 to eject cover 10.

The jettisoning operation is initiated when the munition is nearing the target and the velocity has decreased enough to permit the unprotected antenna to survive. More complex devices were tested in the development of this apparatus which failed to perform because of the harsh environment. The mechanism used is relatively simple yet effective.

Figure 14:
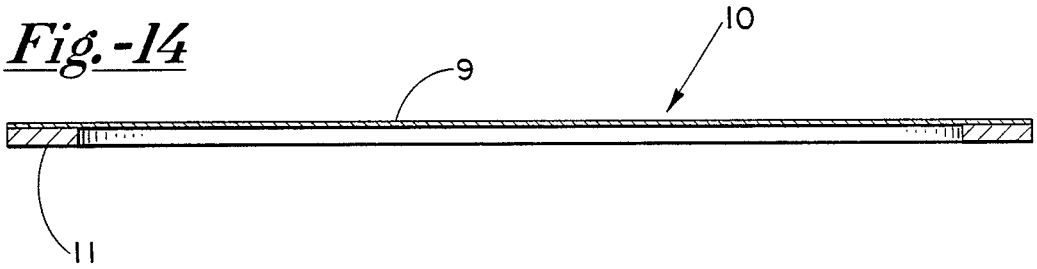
FIG. 14 shows the cross-section view 14—14 of FIG. 6.

An important refinement to this apparatus is shown in FIG. 14 where cover 10 is shown to consist of a flat disk 9 and a washer shaped spacer 11. Spacer 11 performs two important functions in first providing strength about the periphery of the disk and secondly in providing additional space between disk 9 and the munition interior. If the entire disk 9 were made equal to the thickness of the disk and spacer 11 then acceleration and vibration forces would tend to move the disk too far inward shorting out protected electronic components. Further airloading during firing tends to deflect cover 10 and this additional spacing is important to avoid damage to the protected electrical components from this cause.

While this invention has been described with reference to an illustrative embodiment, this description is not intended to be construed in a limiting sense. For example, the arcuate channel illustrated here permits the use of a minimum thickness ring. If desired the channel could be made straight across the chord of the ring segment occupied by the channel with a corresponding increase in ring wall thickness. Various other modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. Apparatus comprising:

(a) a disk shaped cover having opposed and general parallel planar surfaces with one planar surface being exposed and a second planar surface being concealed;

(b) a ring having opposed planar and generally parallel surfaces in a plane perpendicular to the circumference of the ring with one planar surface being exposed and a second planar surface being concealed, the ring having the same diameter as the cover, and having a notch extending inwardly in two dimensions, in a first dimension radially inwardly from the outside edge of the periphery, and in a second dimension inwardly from the concealed planar surface;

(c) a pair of cover slips each having a generally L-shaped cross-section with first parts generally perpendicular to second parts, with the ends of the first parts of the cover clips being attached perpendicular to the exposed planar surface of the ring about the outer periphery spaced approximately 120 degrees apart, and having the second parts of the cover clips extending inwardly over the ring and generally parallel to the exposed planar surface, sized such as to engage the cover periphery when the cover is located adjacent to and aligned with the ring;

(d) a generally straight bar spring attached tangentially to the edge of the disk, such that the spring can be wrapped around the edge thereof, with the spring extending beyond the edge of the disk on one side;

(e) a ring clip attached to the circumference of the cover edge and adjacent the spring thence extending outwardly generally perpendicular to and extending from the concealed planar surface of the cover, and thence being bent at right angles inwardly to extend over and generally parallel to the concealed planar surface of the cover; the ring clip being sized and located to mate with and engage the ring notch when the cover is aligned with and attached to the ring;

(f) a generally tangential projection along the periphery of the ring inclined toward the notch and spaced apart from the notch; with the spring and projection dimensioned and arranged such that the free end of the bar spring can be placed under the projection and bent around the ring towards the notch and the extending portion of the spring wrapped about the edge of the ring, until the cover is adjacent to and covering the planar surface of the ring, with the ring clip engaging the ring at the notch and with the cover slips engaging the cover, to attach the cover to the ring;

(g) translation securing means arranged to prevent the cover from translating with respect to the ring from the attached position;

(h) releasing means for the translation securing means, arranged such that the translation securing means can be released to allow the bar spring to translate the cover to disengage the cover clips and ring clip, and to jettison the cover from the ring.

2. Apparatus as in claim 1 whereby the translation securing means comprises:

(a) the cover having a hole through the opposed planar disk surfaces being located near the perimeter and adjacent to the ring clip on the side of the perimeter opposite to the bar spring;

(b) the ring having a channel extending inwardly from the planar surface with a bottom surface parallel to the ring exposed planar surface and having parallel sides perpendicular to the bottom surface with the channel having an orientation generally perpendicular to the center of a chord of the ring circumference containing the channel, with the channel extending from a point near the perimeter and adjacent to the notch on the side of the perimeter opposite to the spring;

(c) a recess extending towards the center of the ring circumference inward from the side of the channel nearest the center point of the ring circumference and extending upward to the exposed planar surface, the recess bottom surface being planar, parallel with the exposed ring surface and having opposed parallel end surfaces which are generally perpendicular to the bottom surface and to the channel sides and having a planar inner surface generally perpendicular to the recess end surfaces and bottom surface;

(d) a slider dimensioned to slideably fit within the channel and to extend from the bottom surface thereof to a plane parallel to and slightly within the ring planar surface, being sized be radially opposite the recess when located at a first position within the channel;

(e) a detent sized to fit within and mate with the recess being mounted within and sized to extend from the recess beyond the ring exposed planar surface; with the cover hole dimensioned and positioned such that with the detent in place and the cover attached to the ring the detent will extend into the cover hole with an edge of the cover hole bearing against the detent, such that the cover cannot translate from the attached position with respect to the ring;

(f) a shear pin;

(g) the detent and slider each having holes sized to accept the shear pin with the holes being aligned with each other when the detent is located within the recess and the slider is located at the first position within the channel.

3. Apparatus as in claim 2 wherein the translation securing releasing means comprises:

(a) an explosive driven piston actuator;

(b) an extension of the channel extending in a direction around the periphery and away from the notch, being dimensioned to contain and containing the piston actuator with the piston parallel to the bottom surface and extending along the extension, with the piston pointing generally toward the notch and with the extension having a hole through the bottom surface at the end opposite the notch;

(c) a back stop dimensioned to fit between the end of the channel extension opposite the notch and the piston actuator and having an opening therethrough when the back stop is located within the extension, extending from the piston actuator to the hole through the bottom surface of the extension; with the opening dimensioned and located such that actuating wires can be led from the piston actuator through the opening and thence through the hole in the bottom surface of the extension;

(d) the slider having a cutout dimensioned and located, when the slider is in the channel in the first position, such that the cutout includes all portions of the slider located both above the bottom surface of the recess and extending away from the recess in a direction opposite the notch and the ring having a cutout in the outside edge of the channel opposite and matching the recess;

(e) the channel, slider and piston actuator dimensioned such that, when the piston actuator has been actuated to extend the piston, the slider will be displaced to a second position with the slider cutout opposite the recess to both shear the shear pin and to permit the detent to be displaced into the slider cutout and ring cutout.

4. Apparatus as in claim 3 wherein the cover has a washer shaped spacer having the same outer diameter as the cover attached to the concealed planar side.

5. Apparatus as in claim 2 wherein the shear pin is attached through the slider.

6. Apparatus as in claim 1 wherein the channel is arcuate with the sides parallel to the edge of the ring with the slider having a matching arcuate shape.

7. Apparatus as in claim 1 wherein the detent edge is inclined along an edge facing the bottom surface of the recess when the detent is located within the recess, the detent edge being inclined downward and outward from the surface facing the channel to the opposite surface.

8. Apparatus as in claim 2 wherein the cover has two grooves in the surface opposing the cover clips with the cover attached to the ring dimensioned and spaced such that the ring clips each engage a groove.

* * * * *